US008511969B2

(12) United States Patent
Durocher et al.

(10) Patent No.: US 8,511,969 B2
(45) Date of Patent: Aug. 20, 2013

(54) INTERTURBINE VANE WITH MULTIPLE AIR CHAMBERS

(75) Inventors: Eric Durocher, Vercheres (CA); Nicolas Grivas, Dollard des Ormeaux (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 993 days.

(21) Appl. No.: 12/572,142

(22) Filed: Oct. 1, 2009

(65) Prior Publication Data

US 2011/0081228 A1 Apr. 7, 2011

(51) Int. Cl.
*F01D 9/06* (2006.01)

(52) U.S. Cl.
USPC ..... 415/115; 415/116; 415/142

(58) Field of Classification Search
USPC ..... 415/115–116, 142
See application file for complete search history.

(56) References Cited

U.S. PATENT DOCUMENTS 4,126,405 A * 11/1978 Bobo et al. ..... 415/115
4,252,501 A 2/1981 Peill
4,693,667 A * 9/1987 Lenz et al. ..... 415/115
4,987,736 A 1/1991 Ciokajlo et al.
5,356,265 A 10/1994 Kercher
5,597,286 A 1/1997 Dawson et al.
5,609,467 A * 3/1997 Lenhart et al. ..... 415/142
5,630,700 A * 5/1997 Olsen et al. ..... 415/134
6,315,518 B1 * 11/2001 Uematsu et al. ..... 415/115
6,357,999 B1 3/2002 Pearce et al.
6,942,445 B2 9/2005 Morris et al.
6,960,060 B2 11/2005 Lee
6,969,233 B2 11/2005 Powis et al.
7,097,418 B2 * 8/2006 Trindade et al. ..... 415/115
7,140,835 B2 11/2006 Lee et al.
7,383,686 B2 * 6/2008 Aycock et al. ..... 60/782
7,452,189 B2 11/2008 Shi et al.

* cited by examiner

*Primary Examiner* — Christopher Verdier

(74) *Attorney, Agent, or Firm* — Norton Rose Fulbright Canada LLP

(57) ABSTRACT

A gas turbine engine has a mid turbine frame disposed between turbine rotor assemblies. The mid turbine frame includes hollow airfoils radially extending through an annular gas path duct. The airfoils each include a double-walled leading edge structure to define a front chamber separated from a rear chamber defined in the remaining space within the airfoil.

10 Claims, 5 Drawing Sheets

INTERTURBINE VANE WITH MULTIPLE AIR CHAMBERS

TECHNICAL FIELD

The described subject matter relates generally to gas turbine engines and more particularly, to an interturbine vane therefor.

BACKGROUND OF THE ART

A gas turbine engine conventionally includes high and low pressure turbine rotors and one or more interturbine vane arrays in a duct between the low and high pressure turbine rotors. Cooling air is conventionally supplied to cool the outer duct wall and then enters the core cavity of the respective hollow vanes to cool the same and then is discharged from holes defined in the trailing edge of the vanes. Cooling air is thermodynamically "expensive" to the gas turbine engine cycle efficiency, and therefore, optimizing the secondary air flow consumption while providing adequate air flow and pressure margin is desirable.

Accordingly, there is a need for improvement.

SUMMARY

In one aspect, the described subject matter provides a gas turbine engine comprising: a mid turbine frame (MTF) disposed axially between first and second turbine rotors, the MTF including an annular outer case, an annular inner case and a plurality of load spokes radially extending between and interconnecting the outer and inner cases; an annular interturbine duct (ITD) disposed radially between the outer and inner case of MTF, the ITD including an annular outer duct wall and annular inner duct wall, thereby defining an annular hot gas path between the outer and inner duct walls, a plurality of hollow airfoils radially extending between and interconnecting the outer and inner duct walls; a first annular cavity defined between the annular outer case and outer duct wall and a second annular cavity defined between the annular inner duct wall and inner case, the first and second cavities in fluid communication with an inner space in the respective hollow airfoils; each of the hollow airfoils including a double-walled leading edge structure, thereby defining a front chamber in the structure separated from a rear chamber defined in a remaining space within the hollow airfoil, the rear chamber of at least a number of the hollow airfoils accommodating one said spoke to pass therethrough; an annular first seal housing disposed in the first cavity, thereby defining an annular outer front cavity between the first seal housing and an upstream section of the outer duct wall, the outer front cavity being separated from the first cavity; and an annular second seal housing disposed in the second cavity, thereby defining an annular inner front cavity between an upstream section of the inner duct wall and the second seal housing, the inner front cavity being separated from the second cavity, the outer and inner front cavities being in fluid communication with the front chamber of the respective airfoils.

In another aspect, the described subject matter provides a gas turbine engine comprising: a mid turbine frame (MTF) disposed axially between first and second turbine rotors, the MTF including an annular outer case, an annular inner case and a plurality of load spokes radially extending between and interconnecting the outer and inner cases to transfer loads from the inner case to the outer case; an annular interturbine duct (ITD) disposed radially between the outer and inner case of MTF, the ITD including an annular outer duct wall and annular inner duct wall, thereby defining an annular hot gas path between the outer and inner duct walls for directing hot gases from the first turbine rotor therethrough to the second turbine rotor, a plurality of hollow airfoils radially extending between and interconnecting the outer and inner duct walls; each of the hollow airfoils including a double-walled leading edge structure, thereby defining a front chamber in the structure separated from a rear chamber defined in a remaining space within the hollow airfoil; the rear chamber of at least a number of the hollow airfoils accommodating one said spoke to pass therethrough; a first annular cavity defined between the annular outer case and outer duct wall and a second annular cavity defined between the annular inner duct wall and inner case, the first and second cavities being in fluid communication with the rear chamber in the respective hollow airfoils; and an inlet attached to the front chamber of each airfoil for introducing cooling air into the front chamber of the respective airfoils independent from cooling air contained within the rear chamber of the respective airfoils.

In a further aspect, the described subject matter provides, a gas turbine engine comprising: an annular inter-turbine duct (ITD) disposed radially between annular outer and inner engine cases, the ITD including an annular outer duct wall and annular inner duct wall, an annular hot gas path between the outer and inner duct walls, and a plurality of hollow airfoils radially extending between and interconnecting the outer and inner duct walls, a first annular cavity defined between the annular outer case and outer duct wall and a second annular cavity defined between the annular inner duct wall and inner case, the first and second cavities in fluid communication with an inner space in the respective hollow airfoils; each of the hollow airfoils include an inner front wall disposed near a leading edge of the airfoil, extending radially through the airfoil and circumferentially between two opposed side walls of the airfoil, the front wall being connected to at least one of the outer and inner duct walls, thereby defining a front chamber between the inner front wall and the leading edge separated from a rear chamber defined in a remaining space within the hollow airfoils.

Further details of these and other aspects of the described subject matter will be apparent from the detailed description and drawings included below.

DESCRIPTION OF THE DRAWINGS

Reference is now made to the accompanying drawings depicting aspects of the described subject matter, in which.

DETAILED DESCRIPTION

Figure 1:
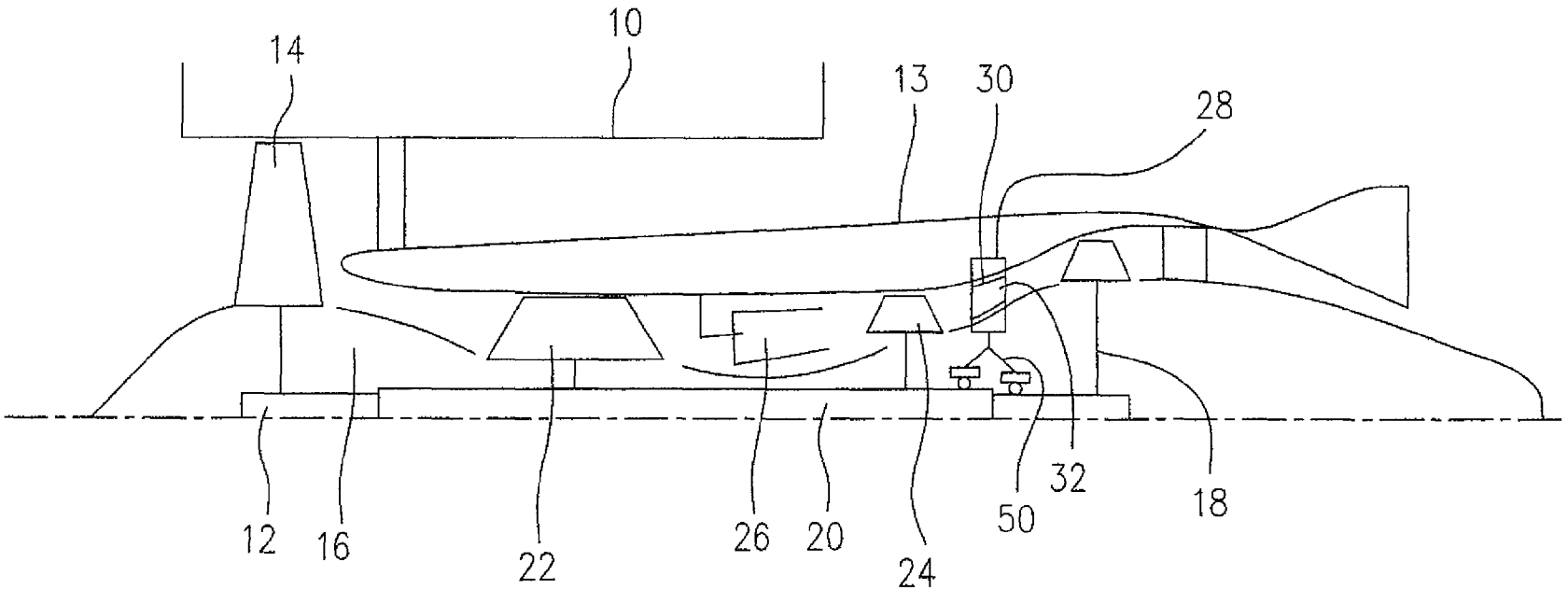
FIG. 1 is a schematic cross-sectional view of a turbofan gas turbine engine according to the present description.

Referring to FIG. 1, a bypass gas turbine engine includes a fan case 10, a core casing 13, a low pressure spool assembly which includes a fan assembly 14, a low pressure compressor assembly 16 and a low pressure turbine assembly 18 connected by a shaft 12 and a high pressure spool assembly which includes a high pressure compressor assembly 22 and a high pressure turbine assembly 24 connected by a turbine shaft 20. The core casing 13 surrounds the low and high pressure spool assemblies to define a main fluid path therethrough. In the main fluid path there is provided a combustor 26 which generates combustion gases to power the high pressure turbine assembly 24 and the low pressure turbine assembly 18. A interturbine duct (ITD) 30 is provided between the high pressure turbine assembly 24 and the low pressure turbine assembly 16. The inter-turbine duct (ITD) 30 in this example includes a mid turbine frame 28 for supporting the duct, as well as other structures, such as a bearing assembly 50.

Referring to FIGS. 1-4, the mid turbine frame 28 includes an annular outer case 33 which has mounting flanges (not numbered) at both ends for connection to other components which cooperate to provide the core casing 13 of the engine. The outer case 33 may thus be a part of the core casing 13. An annular inner case 34 is coaxially disposed within the outer case 33 and a plurality of (at least three) load spokes 36 radially extend between the outer case 33 and the inner case 34. The inner case 34 is coaxially connected to a bearing housing 50 (see FIG. 1) which supports the bearings.

The load spokes 36 are each affixed at an inner end thereof to the inner case 34, for example by welding. The load spokes 36 may be either solid or hollow. Each of the load spokes 36 is connected at an outer end thereof to the outer case 33, for example by a plurality of fasteners (not shown). Therefore, the load spokes radially extend between and interconnect the outer and inner cases 33, 34 to transfer the loads from the bearing housing 50 and the inner case 34 to the outer case 33.

The annular ITD 30 is disposed radially between the outer case 33 and the inner case 34 of the MTF 28. The ITD 30 includes an annular outer duct wall 38 and an annular inner duct wall 40, thereby defining the annular hot gas path 32 between the outer and inner duct walls 38, 40 for directing hot gases to pass therethrough. A plurality of hollow airfoils 42, radially extend between and interconnect the outer and inner duct walls 38 and 40. Each of the hollow airfoils 42 defines an inner space 48. The load spokes 36 in this example radially extend through the respective hollow airfoils 42, or at least through a number of the hollow airfoils (when the number of load spokes 36 is less than the number of hollow airfoils 42).

The MTF 28 defines a first annular cavity 44 between the annular outer case 33 and the annular outer duct wall 38 and a second annular cavity 46 between the annular inner duct wall 40 and the annular inner case 34. The annular first and second cavities 44 and 46 are in fluid communication with the inner space 48 in the respective hollow airfoils 42.

Figure 7:
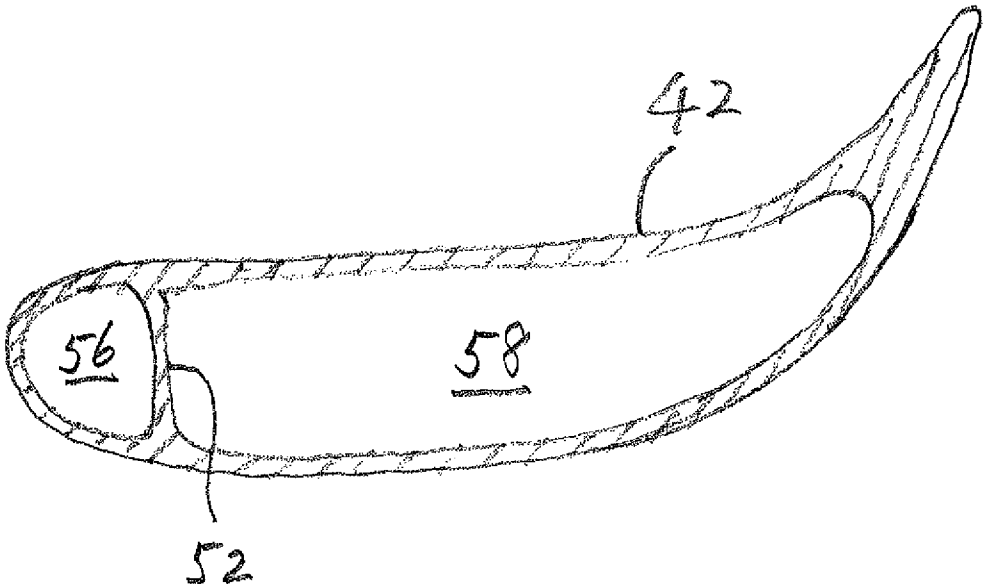
FIG. 7 is a cross-sectional view of the double-walled hollow airfoil of the embodiment of FIG. 2.

Each of the hollow airfoils 42 includes a double-walled leading edge in which an inner front wall 52 extends radially through the hollow airfoil 42, circumferentially between two opposed side walls of the hollow airfoil 42 (see FIG. 7), and located close to the leading edge 54 of the hollow airfoil 42, thereby defining a front chamber 56 between the leading edge 54 of the hollow airfoil 42 and the inner front wall 52. The front chamber 56 is substantially separated from a rear chamber 58, defined in a remaining portion of the inner space 48 of the hollow airfoil 42. The rear chamber 58 is relatively larger than the front chamber 56 and accommodates the load spoke 36 extending therethrough.

The first annular seal plate 60 is disposed in the first cavity 44 located at an upstream section of the outer duct wall 38 with respect to the hot gas flow (not shown) in the hot gas path 32. The front end (not numbered) of the first annular seal plate 60, for example, may be connected to an upstream section of the outer case 33, adjacent to the annular axial front end (not numbered) of the outer case 33. A seal 62 such as a "W" seal may be provided between a radial surface of the outer case 33 and the axial front end 64 of the first seal plate 60. An annular axial rear end 66 of the first seal plate 60 may be connected, for example, with an air seal 68 to an annular section 70 of the outer duct wall 38 located axially between the leading edge 54 of the hollow airfoil 42 and the inner front wall 52. This annular section 70 of the outer duct wall 38 is connected to the inner front wall 52, but is spaced apart from the leading edge 54 of the hollow airfoil 42, thereby defining an opening 72 of the front chamber 56. Therefore, the front chamber 56 through the opening 72 is in fluid communication with a cavity 74 defined between the first annular seal plate 60 and an upstream section of the outer duct wall 38.

A second annular seal plate 76 is disposed in the second annular cavity 46, located at an upstream section of the inner duct wall 40. An annular axial front end (not numbered) of the second annular seal plate 76 may be connected, for example, to a front end (not numbered) of the inner duct wall 40 with a seal 78. An annular axial rear end (not numbered) of the second annular seal plate 76 may be connected, for example, to an annular section 80 of the inner duct wall 40, with an annular seal 82. The annular section 80 of the inner duct wall 40 is located axially between the inner front wall 52 and the leading edge 54 of the hollow airfoil 42. The annular section 80 is connected to the inner front wall 52, but is spaced apart from the leading edge 54 of the hollow airfoil 42, thereby defining an opening 84 of the front chamber 56. Therefore, the front chamber 56 through the opening 84 is in fluid communication with a cavity 86 defined between the second annular seal plate 76 and the upstream section of the inner duct wall 40.

A flow restricting inlet such as one or more metering holes 88 may be defined, for example, in the second annular seal plate 76 for allowing limited cooling air to be introduced from the second annular cavity 46 through the annular inner front cavity 86 into the front chamber 56 in the respective hollow airfoils 42 while preventing massive hot gases from escaping from the front chamber 56 into the first, second cavities 44, 46 and the respective rear chambers 58 of the hollow airfoils 42 when hot gas ingestion results from cracks on a leading edge 54 of one of the airfoils 42.

The cooling air contained in the first, second cavities 44, 46 and in the rear chamber 58 of the respective hollow airfoils 42 is introduced from a cooling air inlet (not shown) defined in the annular outer case 33. For example, such an inlet may be aligned with one or more load spokes 36 which are hollow. Therefore, the hollow spokes 36 direct a cooling air flow radially inwardly into the inner case 34 which is in fluid communication with the second cavity 46. Therefore, when cooling air enters the inner case 34, the cooling air will enter into the second cavity 46 and then the rear chamber 58 of the respective hollow airfoils 42 and then the first cavity 44.

As shown in the drawings, outline arrows are used to indicate cooling air flows in the first, second annular cavities 44, 46 and the rear chamber 58 of the respective hollow airfoils 42 and solid arrows are used to indicate cooling air flows within the front chamber 56 of the respective hollow airfoils 42 and the connected annular outer and inner front cavities 74, 86.

One or more metering holes 90 may be defined in the hollow airfoils 42 at the leading areas for purging a limited cooling air flow from the front chamber 56 into the hot gas path 32 while maintaining the front chamber 56 pressurized. Optionally, more metering holes (not numbered) may be provided in the upstream section of the respective outer and inner duct walls 38, 40 for purging a limited cooling air flow from the respective annular outer and inner front cavities 74, 86 into the hot gas path 32. Purging the air flow through those metering holes will facilitate the motion of cooling air within the front chamber 56 and the connected annular outer, inner front cavities 74, 86 thereby increasing the cooling efficiency. However, the metering holes are carefully designed to allow only a limited cooling air flow to be purged in order to maintain the desired air pressure within the front chamber 56 of the respective hollow airfoils 42.

Similarly, other metering holes (not shown) may be provided in the remaining section of the annular outer, inner duct walls 38, 40 in fluid communication with the respective annular first and second cavities 44, 46, thereby purging cooling air flows from respective first and second annular cavities 44, 46 into the hot gas path 32. These metering holes are also designed to only allow a limited cooling air flow to be discharged in order to maintain a desired cooling air pressure in the first and second annular cavities 44, 46 and the rear chamber 58 of the respective hollow airfoils 42.

Figure 2:
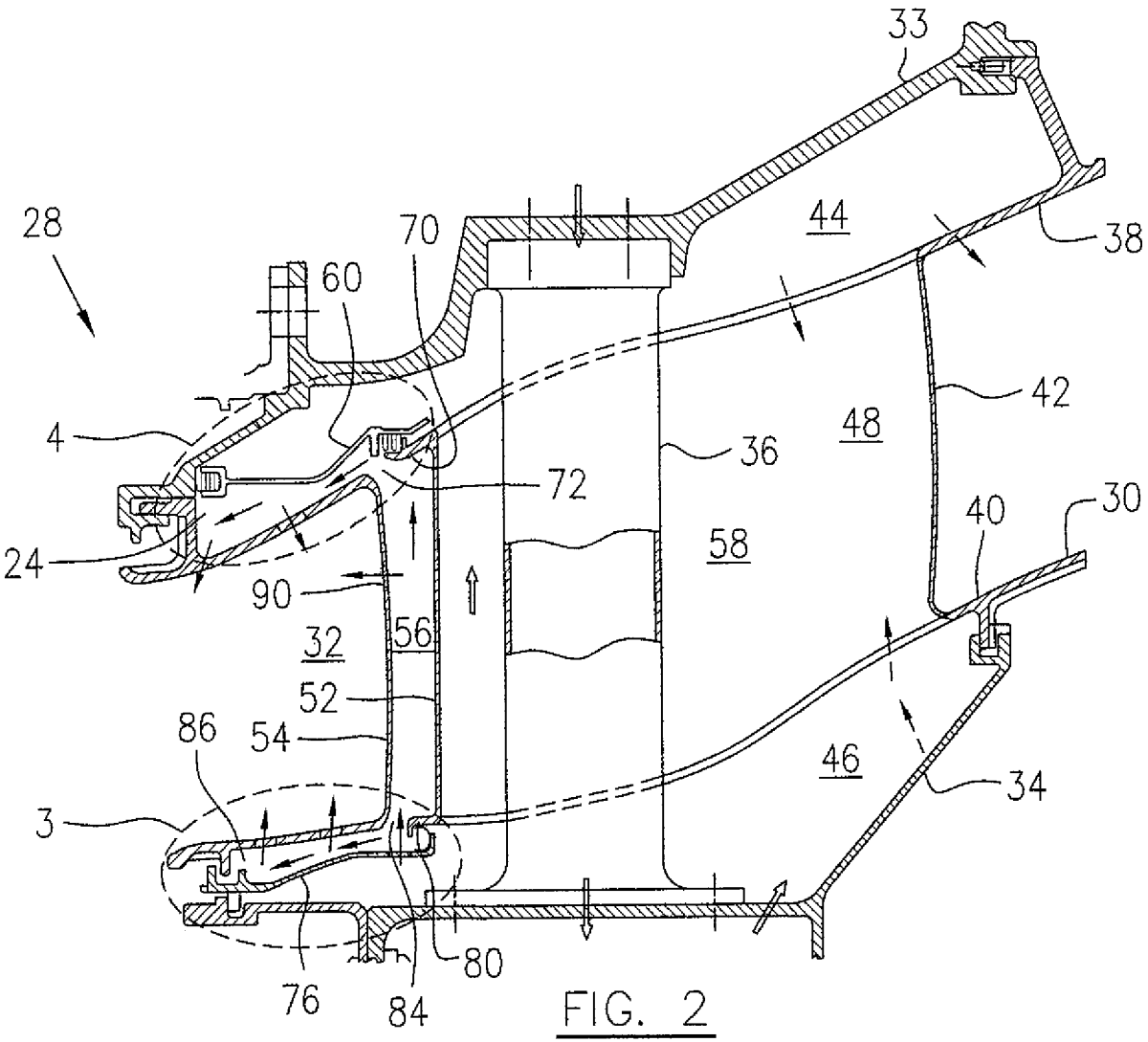
FIG. 2 is a cross-sectional view of a mid turbine frame of FIG. 1, in this example having double-walled hollow airfoils according to one embodiment.
Figure 4:
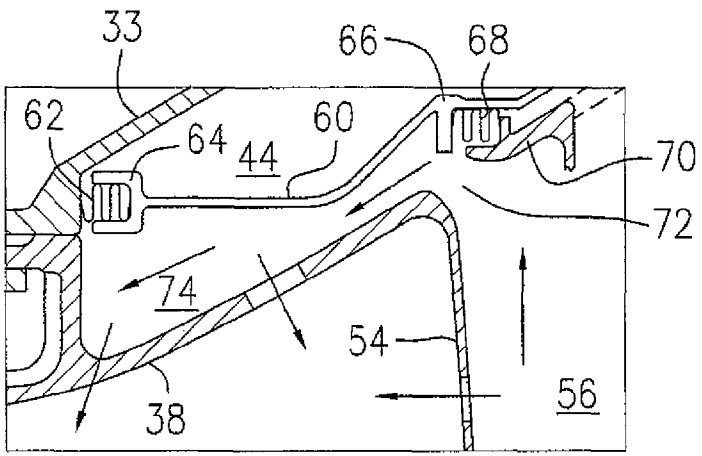
FIG. 4 illustrates a circled area 4 of FIG. 2 in an enlarged scale, showing an annular outer front cavity defined between an upstream section of an outer duct wall of the inter-turbine duct and a first annular seal plate, in fluid communication with the front chamber of the hollow airfoil of the inter-turbine duct.
Figure 3:
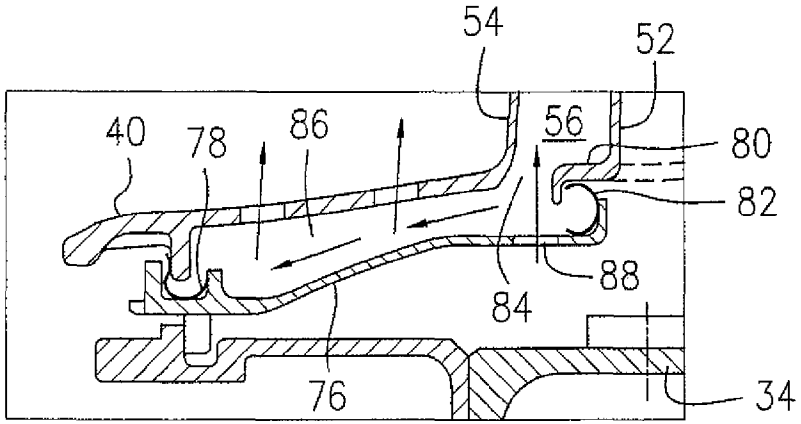
FIG. 3 illustrates a circled area 3 of FIG. 2 in an enlarged scale showing an annular inner front cavity defined between an upstream section of the inner duct wall of an inter-turbine duct and a second annular seal plate, in fluid communication a front chamber of a hollow airfoil of the inter-turbine duct.
Figure 6:
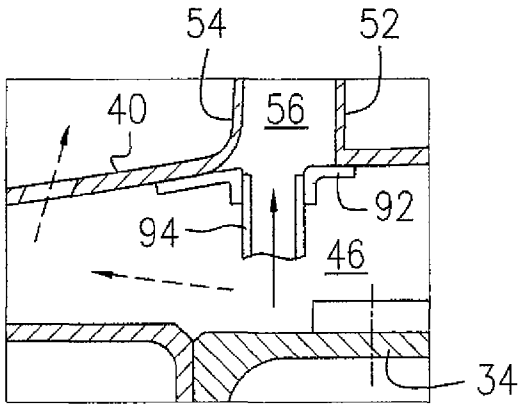
FIG. 6 illustrates a circled area 6 of FIG. 5 in an enlarged scale, showing an inlet of the front chamber of the hollow airfoil for receiving cooling air separately from the cooling air contained within a rear chamber of the hollow airfoil.
Figure 5:
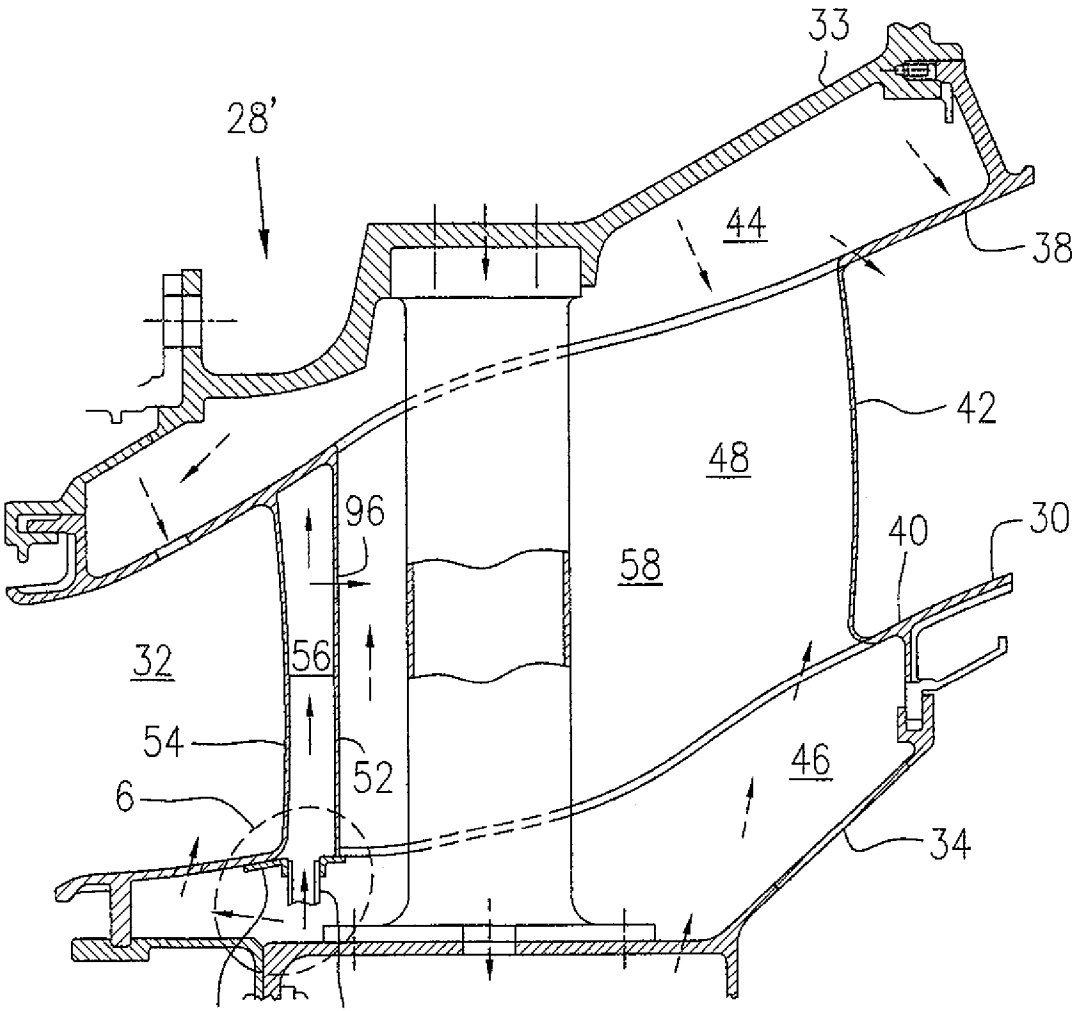
FIG. 5 is a cross-sectional view of a mid turbine frame having double-walled hollow airfoils according to another embodiment.

FIGS. 5 and 6 illustrate another embodiment of the mid turbine frame (MTF) 28', similar to the MTF 28 of FIG. 2. Similar components and features which are indicated by similar numerals will not be redundantly described herein. In contrast to the MTF 28 of FIG. 2 in which the front chamber 56 within the respective hollow airfoils 42 is in fluid communication with one another through the connected annular outer and inner front cavities 74, 86 defined by the respective first and second seal plates 60, 76, the front chamber 56 in the respective hollow airfoils 42 of MTF 28' is separated one from another.

The front chamber 56 of each hollow airfoil 42 of the MTF 28' is closed at a radial outer end by the annular outer duct wall 38, thereby isolating the front chamber 56 of the respective hollow airfoils 42 from the entire annular first cavity 44. The front chamber 56 of the respective hollow airfoils 42 defines an inlet (not numbered) at a radial inner end thereof. The inlet, for example, is formed with a tube fitting 92 for receiving a tube 94 which is in fluid communication with a cooling air source independent from the cooling air contained in the first and second annular cavities 44, 46 and the rear chamber 58 of the respective hollow airfoils 42. Therefore, the front chamber 56 of the hollow airfoils 42 is substantially isolated from the rear chamber 58 of the respective hollow airfoils 42.

As shown in FIGS. 5 and 6, solid arrows are used to indicate a cooling air flow from an independent cooling air source through the tube 94 into the front chamber 56 of the respective hollow airfoils 42 and broken line arrows are used to indicate cooling air flows introduced through the inlet (not shown) defined in the outer case 33 into the first, second cavities 44, 46 and the rear chamber 58 of the respective hollow airfoils 42.

Optionally, the tube fitting 92 and the tube 98 provide to each front chamber 56 may be optionally replaced by a metering hole provided in the annular inner duct wall 40 which closes the radial inner end of the front chamber 56. Therefore, the cooling air introduced into each of the front chamber 56 may be no longer independent from the cooling air contained but is a part of the cooling air contained in the second annular cavity 46, similar to that described in the embodiment of FIG. 2.

One or more metering holes may be provided in the respective hollow airfoils 42 in the leading edge areas, similar to the metering holes 90 shown in FIG. 2 for purging a limited cooling air flow from the front chamber 56 into the hot gas path 32 while maintaining the front chamber pressurized. Alternatively, as shown in FIG. 5, one or more metering holes 96 is provided in the inner front wall 52 for purging a limited cooling air flow from the front chamber 56 into the rear chamber 58 of the hollow airfoils while maintaining the front chamber 56 pressurized. This arrangement may be made particularly when the cooling air pressure in the front chamber 56 and introduced from the tube 94 has a pressure higher than the cooling air pressure contained within the rear chamber 58 of the hollow airfoil 42.

The above description is meant to be exemplary only, and one skilled in the art will recognize that changes may be made to the embodiments described without departure from the scope of the present description. For example, the described subject matter may be applicable to gas turbine engines other than the turbofan type used to illustrate the application of the described subject matter. Still, other modifications which fall within the scope of the present description will be apparent to those skilled in the art, in light of a review of this disclosure, and such modifications are intended to fall within the appended claims.

The invention claimed is:

1. A gas turbine engine comprising:

a mid turbine frame (MTF) disposed axially between first and second turbine rotors, the MTF including an annular outer case, an annular inner case and a plurality of load spokes radially extending between and interconnecting the outer and inner cases;

an annular inter-turbine duct (ITD) disposed radially between the outer and inner case of the MTF, the ITD including an annular outer duct wall and annular inner duct wall, an annular hot gas path between the outer and inner duct walls, and a plurality of hollow airfoils radially extending between and interconnecting the outer and inner duct walls;

a first annular cavity defined between the annular outer case and the outer duct wall, and a second annular cavity defined between the annular inner duct wall and the inner case, the first and second cavities in fluid communication with an inner space in the respective hollow airfoils;

each of the hollow airfoils including a double-walled leading edge structure, thereby defining a front chamber in the structure separated from a rear chamber defined in a remaining space within the hollow airfoil, the rear chamber of at least a number of the hollow airfoils accommodating one said spoke to pass therethrough;

an annular first seal housing disposed in the first cavity, thereby defining an annular outer front cavity between the first seal housing and an upstream section of the outer duct wall, the outer front cavity being separated from the first cavity; and an annular second seal housing disposed in the second cavity, thereby defining an annular inner front cavity between an upstream section of the inner duct wall and the second seal housing, the inner front cavity being separated from the second cavity, the outer and inner front cavities being in fluid communication with the front chamber of the respective airfoils.

2. The gas turbine engine as defined in claim 1 further comprising a flow restricting inlet for allowing limited cooling air to be introduced into the front chamber in the respective airfoils while restricting hot gases from escaping from the front chamber into the first and second cavities and the respective rear chambers when cracks occur on a leading edge of one of the airfoils.

3. The gas turbine engine as defined in claim 2, wherein the flow restricting inlet comprises at least one metering hole defined in the second seal housing for introducing limited cooling air contained in the second cavity through the inner front cavity into the rear chamber of the respective airfoils.

4. The gas turbine engine as defined in claim 1 wherein the load spokes are hollow and extend radially through the rear chamber of the respective hollow airfoils, the hollow spokes directing a cooling air flow radially inwardly into the inner case which is in fluid communication with, and allows the cooling air flow to enter into the first and second cavities and the rear chamber in the respective airfoils.

5. The gas turbine engine as defined in claim 1, wherein the double-walled leading edge structure comprises at least one metering hole for purging a limited cooling air flow from the front chamber into the hot gas path while maintaining the front chamber pressurized.

6. The gas turbine engine as defined in claim 1, wherein the upstream section of the outer duct wall comprises at least one metering hole for purging a limited cooling air flow from the outer front cavity into the hot gas path while maintaining the outer front cavity pressurized.

7. The gas turbine engine as defined in claim 1, wherein the upstream section of the inner duct wall comprises at least one metering hole for purging a limited cooling air flow from the inner front cavity into the hot gas path while maintaining the inner front cavity pressurized.

8. The gas turbine engine as defined in claim 1, wherein a front end of the annular first seal housing is connected to an upstream section of the outer case with a first seal, and wherein a rear end of the annular first seal housing is connected to the outer duct wall at an axial location with a second seal, the axial location being downstream of a first opening of the front chamber of the respective airfoils in respect to the direction of the hot gases passing through the ITD, the first opening being defined in the upstream section of the outer duct wall.

9. The gas turbine engine as defined in claim 1, wherein a front end of the annular second seal housing is connected to a front end of the inner duct wall with a third seal and wherein a rear end of the annular second seal housing is connected to the inner duct wall at an axial location with a fourth seal, the axial location being downstream of a second opening of the front chamber of the respective airfoils, the second opening being defined in the upstream section of the inner duct wall.

10. The gas turbine engine as defined in claim 1, wherein the outer and inner duct walls comprise at least one metering hole for purging limited cooling air from the first and second cavities into the hot gas path.

* * * * *